US006702638B2

(12) United States Patent
Dupont

(10) Patent No.: US 6,702,638 B2
(45) Date of Patent: Mar. 9, 2004

(54) SHATTERPROOFING OF FLUORESCENT LAMPS

(75) Inventor: Paul Robert Dupont, Andover, NJ (US)

(73) Assignee: Custom Spectrum Lighting, LLC, Summit, NJ (US)

( * ) Notice: Subject to any disclaimer, the term of this patent is extended or adjusted under 35 U.S.C. 154(b) by 6 days.

(21) Appl. No.: 10/208,593

(22) Filed: Jul. 30, 2002

(65) Prior Publication Data

US 2002/0187705 A1 Dec. 12, 2002

Related U.S. Application Data

(63) Continuation-in-part of application No. 09/644,163, filed on Aug. 22, 2000, now Pat. No. 6,452,325, which is a continuation-in-part of application No. 09/621,835, filed on Jul. 24, 2000, now abandoned.

(51) Int. Cl.[7] ..... H01J 9/00; H01J 9/20; H01J 9/22

(52) U.S. Cl. ..... 445/58; 445/8; 445/26; 427/67

(58) Field of Search ..... 313/489, 635, 313/493, 110, 478, 572; 220/2.1 R; 445/58, 8, 26; 427/67, 106, 105

(56) References Cited

U.S. PATENT DOCUMENTS

| | | | | |
|---|---|---|---|---|
| 3,602,759 A | | 8/1971 | Evans | 313/112 |
| 3,673,401 A | | 6/1972 | DuPont | 240/114 |
| 4,499,850 A | | 2/1985 | Nolan | 118/406 |
| 4,506,189 A | * | 3/1985 | Nolan | 427/67 |
| 4,507,332 A | | 3/1985 | Nolan | 427/67 |
| 4,924,368 A | | 5/1990 | Northrup | 362/376 |
| 5,034,650 A | | 7/1991 | Nolan | 313/112 |
| 5,043,626 A | | 8/1991 | Nolan | 313/489 |
| 5,124,618 A | | 6/1992 | Ohtaka et al. | 313/489 |
| 5,173,637 A | | 12/1992 | Sica | 313/489 |
| 5,729,085 A | | 3/1998 | Sica | 313/493 |
| 6,406,167 B1 | | 6/2002 | Bock | 362/376 |

FOREIGN PATENT DOCUMENTS

| | | | |
|---|---|---|---|
| GB | 2187037 A | 8/1987 | |
| WO | WO 02/16049 A1 | 2/2002 | 15/4 |

* cited by examiner

*Primary Examiner*—Kenneth J. Ramsey
*Assistant Examiner*—Joseph Williams
(74) *Attorney, Agent, or Firm*—Howard R. Popper

(57) ABSTRACT

A method of shatterproofing a fluorescent lamp having a glass envelope by extruding a polymeric coating over the lamp envelope so that it intimately embraces substantially all of the external contours of the lamp, including its glass envelope and end-ferrules thereby increasing the hoop strength of the glass envelope. The lamp is passed through an air lock into the main lumen of a crosshead which extrudes a cylinder of hot plastic that is radially drawn inward toward the lumen axis by an applied vacuum. A continuous chain of encapsulated lamps emerges from the crosshead that then may be cut apart to reveal individually completely encapsulated lamps.

9 Claims, 4 Drawing Sheets

SHATTERPROOFING OF FLUORESCENT LAMPS

REFERENCE TO RELATED APPLICATIONS

This application is a continuation-in-part of application Ser. No. 09/644,163 filed Aug. 22, 2000 now U.S. Pat. No. 6,452,325 which is a continuation-in-part of application Ser. No. 09/621,835, filed Jul. 24, 2000 now abandoned.

FIELD OF THE INVENTION

This invention relates to fluorescent lamps and, more particularly, to the shatterproofing of fluorescent lamps.

BACKGROUND OF THE INVENTION

In my previous U.S. Pat. No. 3,673,401 I disclosed an arrangement in which a fluorescent lamp could be rendered shatterproof by using a cylindrical, transparent and non-frangible shield of polymeric material together with two rubber-like plastic end-caps. The cylindrical shield was made from a length of extruded plastic tubing having a diameter suitable for each size of fluorescent lamp and the end-caps were provided with a peripheral rib or flange to abut the end of the cylindrical tubing. The arrangement required hand assembly involving several steps. First, one of the end-caps was friction fitted onto the metallic ferrule at one end of the fluorescent lamp. Next, the cylindrical shield was slid over the fluorescent lamp until its end abutted the peripheral rib. Finally, the second end cap was friction fitted over the opposite metallic ferrule and its position adjusted until its peripheral rib abutted the opposite end of the cylindrical shield. Reliability of the shatterproofing depended on how carefully the four elements were put together by the user. If the fluorescent lamp were dropped or fell from its fixture so that its glass envelope broke, the shards of glass as well as the phosphorescent powders and mercury used in the lamp could all be contained. This type of shatterproof fluorescent lamp assembly became very popular in industrial settings, especially those which had to be safeguarded against contamination by toxic particulates and materials.

More recently patents have been issued directed to making the assembly hold together more securely. Thus, U.S. Pat. Nos. 5,173,637 and 4,924,368 teach that an adhesive should be applied to the exterior of the metallic ferrule of the lamp so as to cause the end cap to better adhere to the lamp. While the use of adhesive allowed greater tolerances to be employed in the fabrication of the end-cap and thus facilitated assembly as compared to using an end-cap whose inner diameter was friction-fitted to tightly embrace the metallic ferrule, the assembly operation remained a somewhat tedious hand operation requiring the lighting maintenance personnel to manually put together the elements of the fluorescent lamp protection assembly in the field rather than merely replacing burned-out lamps. It would be advantageous to eliminate the need for field assembly as well as to provide a more reliable encapsulation method.

SUMMARY OF THE INVENTION

In accordance with the principles of the present invention, as exemplified by the illustrative embodiment, a shatterproof fluorescent lamp assembly is achieved capable of containing within a polymeric envelope all of the glass, powders and mercury used in the lamp. A protective polymeric coating, advantageously a polycarbonate, is extruded directly on to the fluorescent lamp so as to be in intimately conforming embracing contact with substantially all of the contours of the lamp's glass envelope and the ferrules at the end of the glass envelope thereby increasing the hoop strength of the glass. If the lamp is struck with sufficient force to break glass envelope, the polymeric coating will generally confine the breakage to the local area struck and, in experimental tests, the lamp will remain illuminated for a measurable period.

According to the method of the invention, the increased hoop strength of the glass envelope is achieved by passing the lamp through an air lock into the main lumen bore of an extruder crosshead which is connected to vacuum pump. A cylinder of hot, polymeric material is extruded and radially drawn inward toward the periphery of the lamp by the vacuum. The extruded cylinder should have a wall thickness, so that when cooled, it will exhibit sufficient beam strength to maintain the cylindrical shape even if the glass envelope of the fluorescent tube is shattered.

According to the preferred embodiment, prior to inserting the fluorescent lamp into the extruder crosshead, the fluorescent lamp is wiped down to remove any dust. Advantageously a plastic end cap may be slipped over the ferrule at the end of the fluorescent lamp to cover the vent holes which certain types of fluorescent lamps exhibit. Alternatively, a short length of easily removable silicone tubing may be fitted over the electrical terminals at each end of the lamp to protect the terminals from being coated with extrudate and the metallic ferrules of the lamp may be pre-coated with an adherent which, advantageously, may be a heat-activated adhesive. According to another embodiment, instead of using an adhesive, each end of the lamp may advantageously be heated and then immersed in an air-fluidized bed of powdered ethylene vinyl acetate to pre-coat the metallic ferrules of the lamp. The prepared lamp is then introduced into the airlock of the extruder crosshead to receive the cylindrical sheath which adheres to the contours of the lamp.

Advantageously, as the trailing end of the first fluorescent lamp enters the crosshead, a second fluorescent lamp is inserted so as to make the process continuous for a number of successive lamps. At a convenient distance downstream from the crosshead, power driven rollers move the encapsulated lamp to a first cutting position where the extrudate between successive lamp ends is sheared, separating the encapsulated lamps from one another. Further downstream a heated iron is advantageously used to seal the extrudate to the plastic end cap. The silicone tubing used to cover the electrical terminals may now be removed and the coated, shatterproofed lamps may then be packed for shipment.

BRIEF DESCRIPTION OF THE DRAWING

The foregoing objects and features of the present invention may become more apparent from a reading of the ensuing description, together with the drawing, in which.

DESCRIPTION

Figure 1:
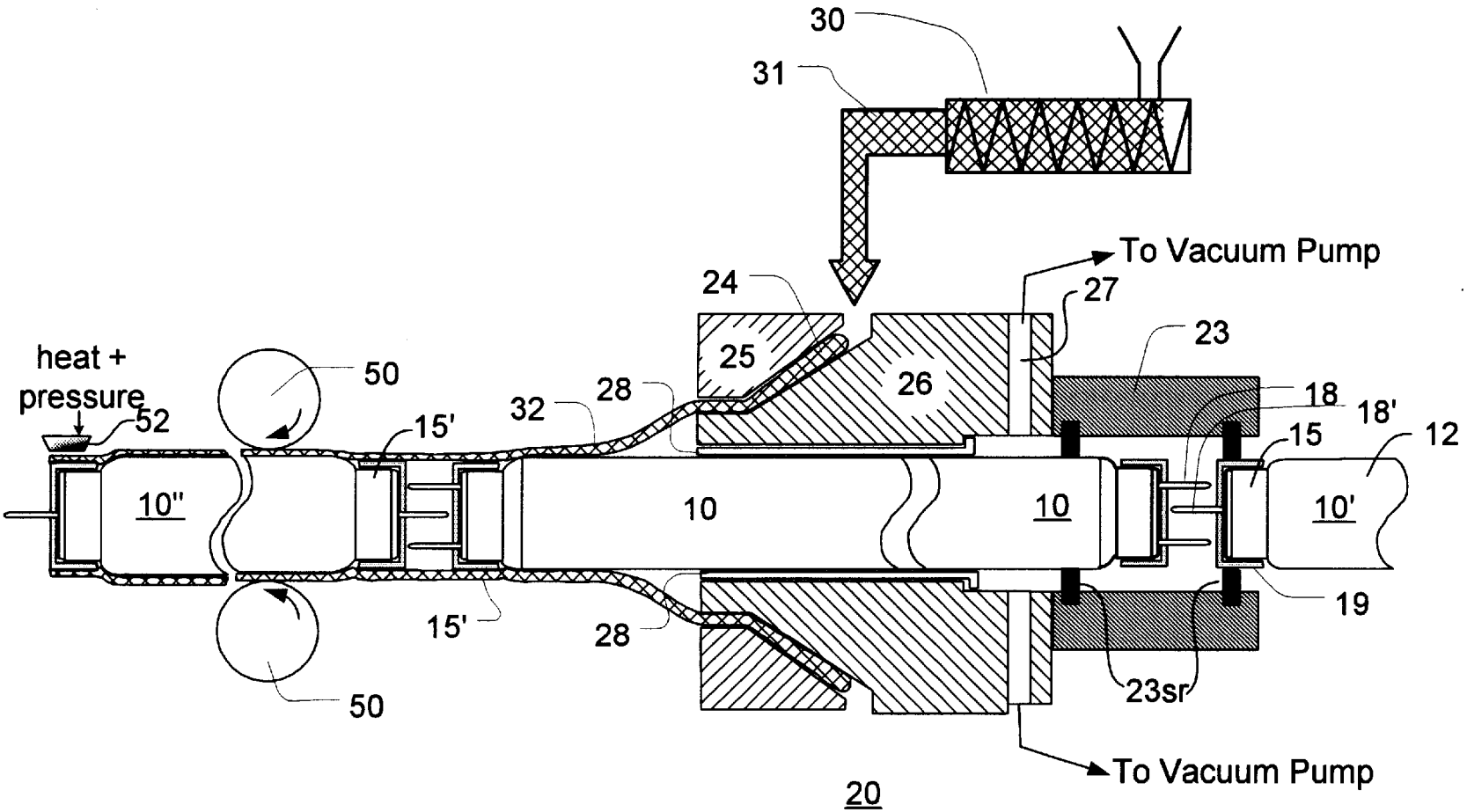
FIG. 1 is an overall view showing a preferred embodiment of the encapsulation method of the invention.

In FIG. 1, a conventional, commercially available fluorescent lamp 10, 10', 10" is depicted at various phases of its passage through the encapsulation method of the invention. Lamp 10 includes an elongated glass tube 12 at each end of which a usually metallic ferrule 15, 15' is cemented on. Fluorescent lamps may be conventionally equipped with either a single electrical terminal or, as shown, a pair of electrical terminals 18, 18' at each end. In some forms of fluorescent lamp the electrical terminals protrude from a fiber end plate (not shown) that is retained by the ferrule. In some cases the fiber end plate has holes to permit outgassing of the cement used to adhere the ferrule to glass envelope 12.

As shown in my previous patent, the prior art the practice was to enclose the glass tube portion 12 of the fluorescent lamp 10 within a larger diameter sleeve made of a semi-rigid, nonfrangible transparent tubing of polymeric material. The protective sleeve was secured to the ferrules 15 by means of rubber end caps that were frictionally fit over the cups. In the prior art it was always thought to be necessary to have the diameter of the protective sleeve larger than the outside diameter of the glass envelope not only to facilitate assembly, but also to provide an "air gap" for various purposes. In accordance with the invention, there is no need for such an air gap, and no need for end caps and a hand fitting and assembly operation to be performed in the field. Instead, referring to FIG. 1 (not drawn to scale), plastic is extruded over fluorescent lamp 10 to encapsulate the lamp as it passes through crosshead 20 connected to a screw extruder 30.

Prior to introducing lamp 10 into crosshead 20, an end cap 19 may be applied over the metallic ferrules 15, 15' at each end of the lamp to seal the holes in its fiber end plate (not shown). Advantageously, an adhesive may be applied to the circumference of the ferrule to adhere the end cap and to overlap a small portion of its end plate. The lamp is introduced into cross-head 20 through air lock 23. As shown in fuller detail in FIGS. 5 and 6 respectively, air lock may advantageously include a stage of feed-through rollers 22 to facilitate alignment and passage of the lamp through the lumen of crosshead 20. The lumen of the crosshead is provided with a port 27 connected to a vacuum pump (not shown). In addition, the lumen is advantageously provided with a friction-reducing sleeve 28 of Teflon or similar material to facilitate passage of the lamp. As lamp 10 passes through crosshead 20 downstream of vacuum port 27, extruder 30 injects molten thermoplastic material 31 under pressure into the annular space 24 between crosshead parts 25 and 26 effectuating a cylindrical extrudate 32. Because of the vacuum applied to ports 27 and the sealing action of air lock 23 the extruded cylinder of hot, plastic material 32 is drawn radially inward and into intimately conforming embracing contact with the outer surfaces of lamp 10.

Figure 2:
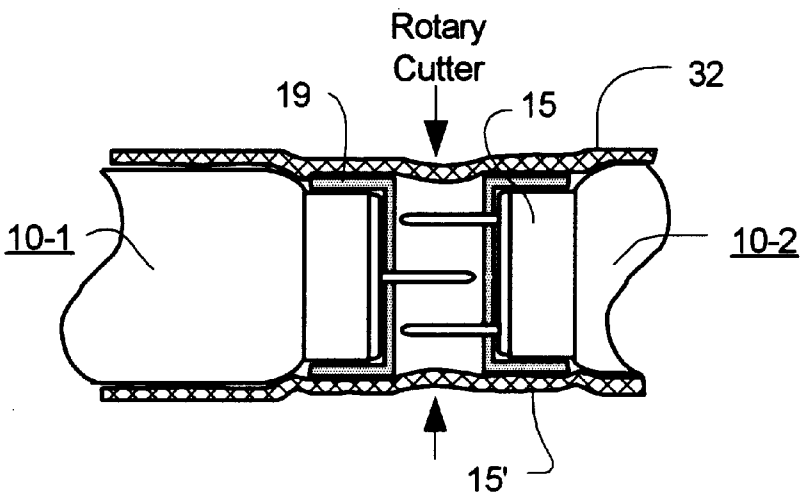
FIG. 2 shows the details of a sequence of encapsulated fluorescent lamps which have passed through the crosshead apparatus of FIG. 1, but prior to the sequence of encapsulated lamps being cut apart.

To increase throughput, it is advantageous to introduce a second lamp 10' into crosshead 20 through air lock 23 so that it can be encapsulated in similar fashion to the first lamp in a continuous extrusion process wherein a sequence of encapsulated lamps closely follow one another through crosshead 20. At a convenient distance downstream from crosshead 20 a set of power driven take-up rolls 50 grasps the encapsulated lamp 10", drawing it away from the extruder and, to some extent, causing some thinning of the wall thickness of the extruded material at the ends of the lamp, as shown more clearly in the enlarged views of FIGS. 2 and 3. Thereafter, the sequence of encapsulated lamps 10", 10 is cut apart. As shown in FIG. 2, the encapsulating sleeve 32 is cut between successive lamps 10-1 and 10-2 along the line "cut—cut". Advantageously, the extrudate 32 may be heat sealed to end cap 19 by a heated iron or pressure roller 52. Note that coating 32 intimately embraces the various contours of lamp 10 at points 32*a*, 32*b*, 32*c* and 32*d* thereby providing complete containment for all of the lamps internal components should its glass envelope 12 be broken. At this point the encapsulated lamp may be packed and shipped to the field where it may be installed without any additional labor being required.

Figure 4:
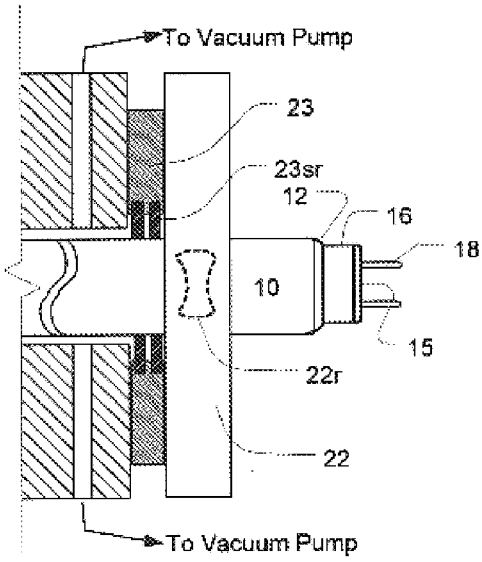
FIG. 4 shows the air lock seal and guide rollers of an alternative embodiment of the crosshead air lock.
Figure 6:
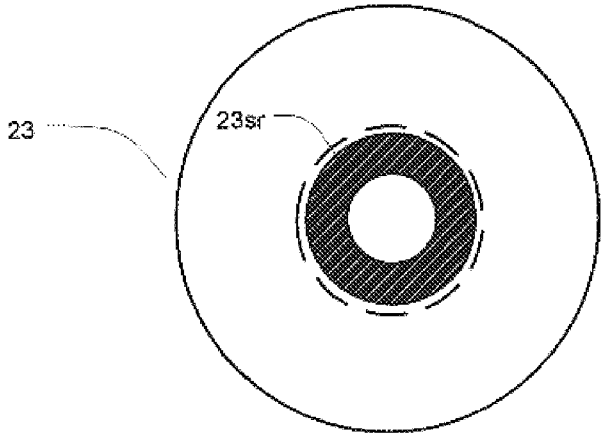
FIG. 6 shows an end view of one of the sealing rings of the crosshead air lock.
Figure 5:
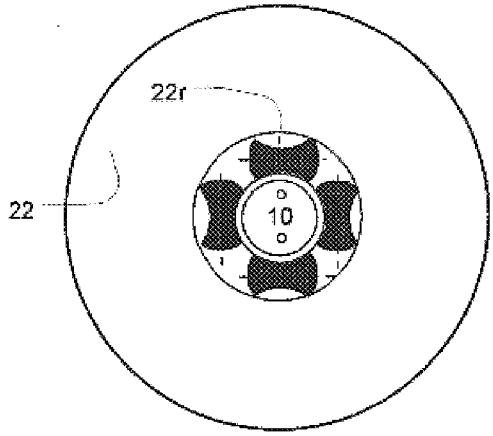
FIG. 5 shows an enlarged view of the guide rollers of FIG. 4.

FIGS. 4, 5 and 6 show details of the air lock 23 including the set of optional alignment rollers 22*r* at the input end of crosshead 20 through which fluorescent lamps are introduced for encapsulation. Alignment rollers 22*r* assist in axially aligning lamp 10 with the lumen 28 of crosshead 20. Rollers 22*r* are advantageously made of rubber like material to assist in guiding the glass envelope 12 of lamp 10 through the crosshead. Rollers 22*r* may advantageously be power driven. Air seal 23 includes a pair of sealing rings 23*sr* whose inner diameter is made slightly smaller than the outer diameter of the glass envelope 12 to maintain the vacuum in the lumen of crosshead 20 against air leakage.

Figure 7:
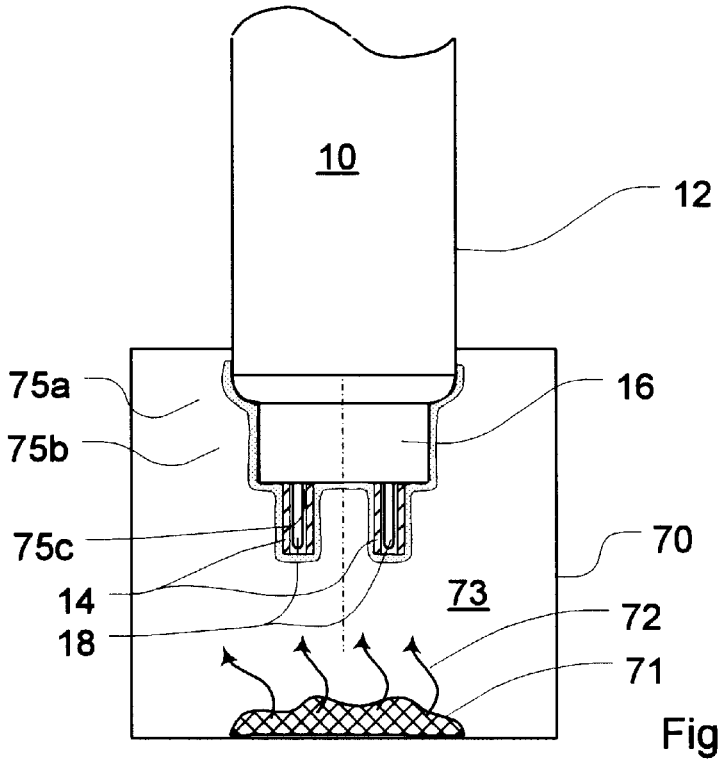
FIG. 7 shows an alternative embodiment in which the end of a fluorescent lamp is immersed in an air-fluidized bed of powdered plastic to provide a coating which facilitates adhesion of the extrudate.
Figure 8:
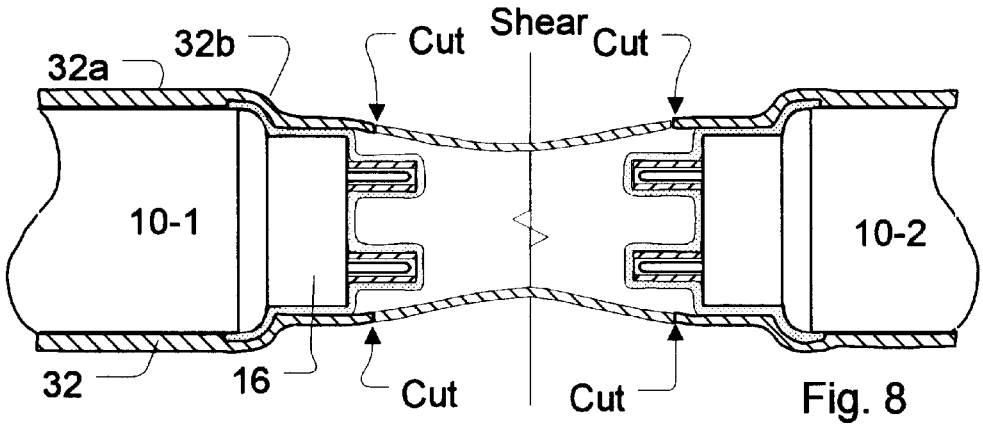
FIG. 8 shows an alternative method of encapsulating a sequence of fluorescent lamps.
Figure 9:
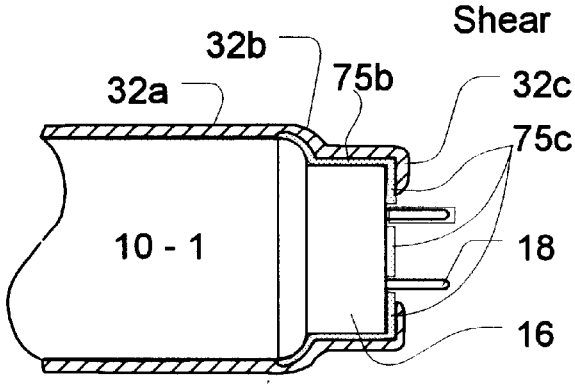
FIG. 9 shows details of an alternative form of sealing the extrudate to the lamp end.

Referring now to FIGS. 7 through 9 an alternative process for encapsulating fluorescent lamps is disclosed. First, a protective silicone sleeve 14 is slipped over the electrical terminals of the lamp. Then a short length at the ends of each lamp 10 is heated, advantageously by being exposed to an infrared heat source (not shown). The heated end portion of the lamp should embrace the end ferrule 16 and a short length of the glass envelope 12. The heated end portion is then immersed in a container 70 containing an air stone 71 and a quantity of plastic powder, advantageously ethylene vinyl acetate which has been freeze dried and ground into powder. Air stone 71 may advantageously be similar to the type often employed in aquariums. Air stone 71 is connected to an air supply (not shown) to produce upwardly directed air streams 72 that turn the plastic powder into a cloud or air-fluidized plastic bed 73. The air-fluidized powder adheres to the heated lamp end thereby providing a pre-coating 75*a*, 75*b* and 75*c*. Portion 75*a* adheres to the end portion of glass tube 12, portion 75*b* adheres to the ferrule 16 and portion 75*c* adheres to the transverse part of the terminal-bearing portion of the lamp.

The pre-coated lamp end is then inserted into the crosshead of the extruder to receive the extruded main cylindrical coating 32, as described above. Referring to FIG. 8, portion 32*a* of the extruded coating adheres to the cylindrical portion of glass envelope 12. Portion 32*b* of the extruded coating adheres to the transitional portion of the glass envelope 12 which has now been coated with coating 75*a*. Similarly, Portion 32*c* of the extruded coating now adheres to the pre-coated ferrule portions 75*b* of lamp 10.

As described above, after a first lamp 10-1 has exited the crosshead, a second lamp 10-2, also having its ends pre-coated with coating 75, may advantageously be inserted into the crosshead. FIG. 8 show a succession of lamps 10-1, 10-2 encapsulated by coating 32, after having exited the extruder. FIG. 9 shows a lamp end after the coating 32 between successive lamps 10-1 and 10-2 has been sheared and after the protective silicone sleeves 14 have been removed. Coating 32 is then trimmed at the "cut" lines shown in FIG. 8. This embodiment of the invention has the advantage that the extrudate 32 and pre-coating 75 adhering to each other, especially at point 32*c* and 75*c*, provide a more complete encapsulation of the lamp 10.

Figure 3:
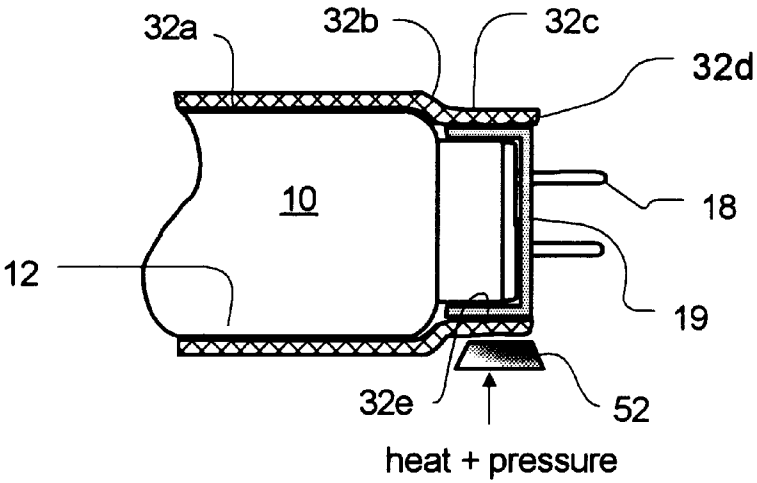
FIG. 3 shows the heat sealing of the extrudate to the plastic end cap.

The foregoing is deemed to be illustrative of the principles of the invention. It should be apparent that the polymeric extrudate 32 may be made of polyethylene, acrylic, PETG, polycarbonate or any other similar material with a wall thickness affording sufficient beam strength to retain its cylindrical shape should the glass envelope be fractured. In particular, it should be noted that while fluorescent lamps are no longer manufactured in a variety of colors because of environmental concerns caused by the metallic compounds used in some colored fluorescent powders, such powders may safely be incorporated in the extrudate since they are completely encapsulated in the plastic coating itself. Accordingly, a variety of differently colored plastic envelopes may be extruded over a white fluorescent lamp. In one illustrative embodiment, the polymeric coating 32, as shown in FIG. 3, had a wall thickness 32 of approximately 0.015", a wall thickness 32*b* of approximately 0.016" and a wall thickness 32*c* at the end of ferrule 15 of approximately 0.006". It should be appreciated that the interior diameter of protective tubing 14 should fit snugly over contacts 18 and that the end of tubing 14 may be spaced apart from the end wall of the ferrule to facilitate cutting through of the extrudate 32. Further and other modifications may be made by those skilled in the art without, however, departing from the spirit and scope of the invention.

What is claimed is:

1. A method of shatterproofing a fluorescent lamp having a glass envelope comprising the steps of extruding a hot, polymeric coating over the exterior surface of said envelope, and drawing said coating into intimately embracing conforming contact with said envelope to increase the hoop strength thereof.

2. A method of shatterproofing a fluorescent lamp according to claim 1 wherein a vacuum is applied to draw said hot polymeric coating into intimately conforming contact with the contour of said envelope.

3. A method of shatterproofing according to claim 2 wherein said lamp includes a ferrule at each end and wherein said coating is vacuum drawn into intimately conforming contact with said ferrule.

4. A method of shatterproofing a fluorescent lamp having a glass envelope and a ferrule at each end, comprising:

a) introducing said fluorescent lamp into the central bore of an extruder crosshead which produces a substantially cylindrical extrudate;

b) applying a vacuum to the extruder bore to draw said extrudate radially inward toward the axis of said bore and into intimately conforming contact with the exterior surfaces of said glass envelope and ferrules.

5. A method according to claim 4 wherein a succession of fluorescent lamps are introduced into said crosshead, said succession of lamps being continouslly encapsulated by said extrudate.

6. A method according to claim 5 wherein said succession of lamps is introduced into said crosshead through an air lock.

7. A method according to claim 6 wherein said airlock includes a pair of sealing rings.

8. A method according to claim 6 wherein said airlock is dimensioned to accommodate the ends of two fluorescent lamps between said sealing rings.

9. A method according to claim 5 wherein said extrudate is cut through between successive ones of said lamps after said lamps exit said extruder.

* * * * *